US010981187B2

(12) United States Patent
McGarry

(10) Patent No.: US 10,981,187 B2
(45) Date of Patent: Apr. 20, 2021

(54) DEVICES AND METHODS FOR MULTI-DIRECTIONAL FLUID PUMPING

(71) Applicant: Melissa McGarry, Los Angeles, CA (US)

(72) Inventor: Melissa McGarry, Los Angeles, CA (US)

( * ) Notice: Subject to any disclaimer, the term of this patent is extended or adjusted under 35 U.S.C. 154(b) by 0 days.

(21) Appl. No.: 16/014,879

(22) Filed: Jun. 21, 2018

(65) Prior Publication Data

US 2019/0388922 A1 Dec. 26, 2019

(51) Int. Cl.
*B05B 11/00* (2006.01)

(52) U.S. Cl.
CPC ..... *B05B 11/3052* (2013.01)

(58) Field of Classification Search
CPC ..... B05B 11/3011; B05B 11/0059; B05B 11/3052
USPC ..... 222/376, 321.4
See application file for complete search history.

(56) References Cited

U.S. PATENT DOCUMENTS 1,185,639 A * 6/1916 Dunlap ..... B05B 11/0059 222/376
1,735,784 A * 11/1929 Olson ..... B05B 11/0059 222/211
2,556,180 A * 6/1951 Hamilton ..... B05B 11/0059 222/321.4
2,924,360 A * 2/1960 Samuel ..... B65D 83/32 222/402.19
4,099,655 A * 7/1978 Por ..... B05B 11/0059 222/211
4,277,001 A * 7/1981 Nozawa ..... B05B 11/0059 222/321.4
4,886,212 A 12/1989 Proctor et al.
5,119,974 A 6/1992 Mann
5,624,060 A * 4/1997 Ellion ..... B05B 11/0059 222/376
5,657,909 A * 8/1997 Barriac ..... B05B 11/0059 222/382
6,126,042 A * 10/2000 Meshberg ..... B05B 11/0013 222/321.4
6,386,399 B1 * 5/2002 Tsujii ..... B05B 11/0059 222/376
7,011,237 B1 * 3/2006 Sayers ..... B05B 11/0059 222/321.9
7,331,489 B2 * 2/2008 Glynn ..... G01F 11/288 222/205
2008/0264977 A1 * 10/2008 Moudgill ..... B05B 11/0059 222/376

(Continued)

*Primary Examiner* — Vishal Pancholi
(74) *Attorney, Agent, or Firm* — UCLA Patent Law Clinic

(57) ABSTRACT

Devices and methods for multi-directional fluid pumping in accordance with embodiments of the invention are disclosed. In one embodiment, the multi-directional fluid pumping device comprises a reservoir containing a fluid; a sprayer head that attaches to the reservoir and comprises a piston connecting to a tube that encases a top portion of a first feed and a second feed; a first plug and a second plug that close off the first and second feeds when in particular configurations; and a first piece and a second piece connected to the top portion of the first feed and the second feed, respectively, and accesses the fluid in the reservoir. The first and the second plug may utilize a first and a second ball, a first and a second catch, and a first and a second constricted portion to control the flow of the fluid.

14 Claims, 11 Drawing Sheets

(56) References Cited

U.S. PATENT DOCUMENTS

2018/0050163 A1 2/2018 DeAnglis et al.

* cited by examiner

DEVICES AND METHODS FOR MULTI-DIRECTIONAL FLUID PUMPING

FIELD OF THE INVENTION

The present invention generally relates to fluid devices and more specifically to devices and methods for multi-directional fluid pumping.

BACKGROUND

Spray bottles are used for a variety of purposes in daily life from kitchen cleaning to the dispensing of perfumes and scents. Many spray bottles use a pumping device or mechanism to draw liquid and force it through a nozzle. The pumping mechanism often utilizes a tube that accesses the fluid in the bottle.

SUMMARY OF THE INVENTION

The various embodiments of the present multi-directional fluid pumping devices contain several features, no single one of which is solely responsible for their desirable attributes. Without limiting the scope of the present embodiments, their more prominent features will now be discussed below. In particular, the present multi-directional fluid pumping devices will be discussed in the context of spray bottles. However, the use of spray bottles is merely exemplary and various other forms may be utilized for multi-directional fluid pumping as appropriate to the requirements of a specific application in accordance with various embodiments of the invention. After considering this discussion, and particularly after reading the section entitled "Detailed Description," one will understand how the features of the present embodiments provide the advantages described here.

In a first aspect, the multi-directional fluid pumping device may comprise a reservoir containing a fluid; a sprayer head that attaches to the reservoir and comprises a piston connecting to an encasement member that encases a top portion of a first feed and a second feed; a first plug and a second plug that close off the first feed and the second feed when in particular configurations; and a first piece and a second piece connected to the top portion of the first feed and the second feed, respectively, and accesses the fluid in the reservoir.

In an embodiment of the first aspect, the first plug may comprise a first constricted portion, such that a cross-sectional area of the first feed is larger closer to the first catch than away from it.

In another embodiment of the first aspect, the second plug may comprise a second constricted portion, such that a cross-sectional area of the second feed is larger closer to the second catch than away from it.

In another embodiment of the first aspect, the first plug may comprise a first ball and a first catch, wherein in an upright configuration the first catch does not capture the first ball and closes off the first feed and in an upside-down configuration the first catch captures the first ball and opens up the first feed.

In another embodiment of the first aspect, the second plug may comprise of a second ball and a second catch, wherein in the upright configuration the second catch captures the second ball and opens up the second feed and in the upside-down configuration the second catch does not capture the second ball and closes off the second feed.

In another embodiment of the first aspect, the first piece may include a first rotating cuff that rotates about the first feed using gravity to provide access to the fluid.

In another embodiment of the first aspect, the second piece may include a second rotating cuff that rotates about the second feed using gravity to provide access to the fluid.

In another embodiment of the first aspect, the first piece may include a first extension, and the first feed rotates about a central axis of the second feed.

In another embodiment of the first aspect, the second piece may include a second extension, and the second extension rotates about the central axis of the second feed.

In another embodiment of the first aspect, the first feed and the second feed may be sealed at the base.

In a second aspect, a method for pumping fluids may comprise of: inputting a fluid into a reservoir connected to a sprayer head that comprises a piston and an encasement member connecting to a first feed and a second feed; positioning the sprayer head so that it faces a targeted location; rotating a first and a second piece such that the first feed and the second feed attached to the first and the second piece, respectively, access the fluid in the reservoir; closing off the first feed with a first plug when the sprayer head is in an upright configuration; closing off the second feed with a second plug when the sprayer head is in an upside-down configuration; and pumping the fluid to the sprayer head through the first and second feed using the piston.

In an embodiment of the second aspect, the first plug may comprise a first constricted portion, such that a cross-sectional area of the first feed is larger closer to the first catch than away from it.

In another embodiment of the second aspect, the second plug may comprise a second constricted portion, such that a cross-sectional area of the second feed is larger closer to the second catch than away from it.

In another embodiment of the second aspect, the first plug may comprise a first ball and a first catch, wherein in an upright configuration the first catch does not capture the first ball and closes off the first feed and in an upside-down configuration the first catch captures the first ball and opens up the first feed.

In another embodiment of the second aspect, the second plug may comprise of a second ball and a second catch, wherein in the upright configuration the second catch captures the second ball and opens up the second feed and in the upside-down configuration the second catch does not capture the second ball and closes off the second feed.

In another embodiment of the second aspect, the first piece may include a first rotating cuff that rotates about the first feed using gravity to provide access to the fluid.

In another embodiment of the second aspect, the second piece may include a second rotating cuff that rotates about the second feed using gravity to provide access to the fluid.

In another embodiment of the second aspect, the first piece may include a first extension, and the first feed rotates about a central axis of the second feed.

In another embodiment of the second aspect, the second piece may include a second extension, and the second extension rotates about the central axis of the second feed.

In another embodiment of the second aspect, the first feed and the second feed may be sealed at the base.

BRIEF DESCRIPTION OF THE DRAWINGS

The various embodiments of the present multi-directional fluid pumping device now will be discussed in detail with an emphasis on highlighting the advantageous features. These embodiments depict the novel and non-obvious multi-directional fluid pumping devices shown in the accompanying drawings, which are for illustrative purposes only. These drawings include the following figures.

DETAILED DESCRIPTION OF THE DRAWINGS

Figure 1:
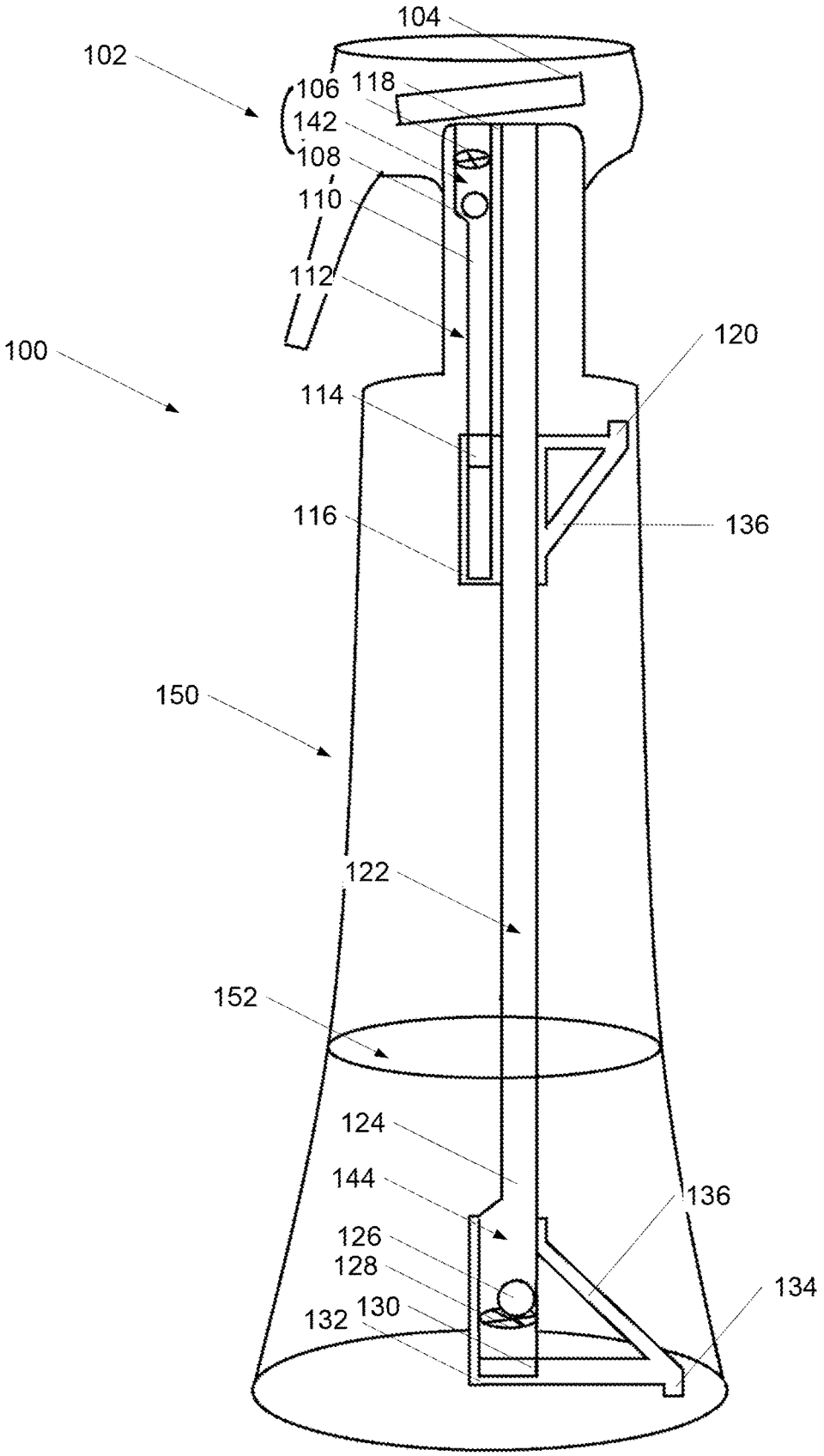
FIG. 1 is a diagram of the multi-directional fluid pumping device in an upright configuration using rotating cuffs, in accordance with an embodiment of the invention.

The following detailed description describes the present embodiments with reference to the drawings. In the drawings, reference numbers label elements of the present embodiments. These reference numbers are reproduced below in connection with the discussion of the corresponding drawing features.

Turning now to the drawings, devices and methods for multi-directional fluid pumping in accordance with embodiments of the invention are disclosed. In many embodiments, a multi-directional fluid pumping device may utilize a plurality of feeds that may be connected to a plurality of rotary cuffs and plurality of feed extensions to access fluids stored in a reservoir regardless of the orientation of the pumping device. In various embodiments, the pumping device may also include a plurality of plugs to control the flow of fluids by shutting off one or more empty feeds. In several embodiments, each of the plurality of plugs may comprise a ball, a catch that stops the ball but not the flow of fluids, and a tube having a constricted portion such that when the feed is empty the ball closes the feed. The upright configuration of the multi-directional fluid pumping device using rotating cuffs, in accordance with embodiments of the invention is further discussed below.

Figure 2:
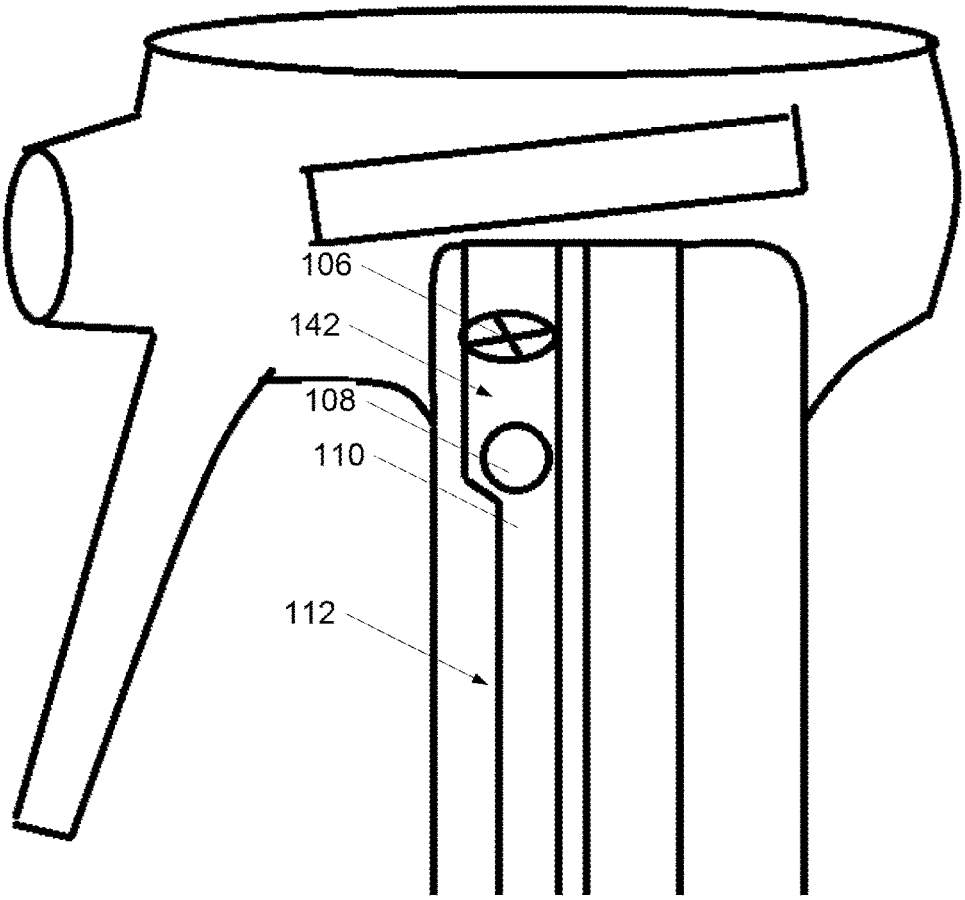
FIG. 2 is a close-up diagram of the first feed of the multi-directional fluid pumping device in an upright configuration using rotating cuffs, in accordance with an embodiment of the invention.
Figure 3:
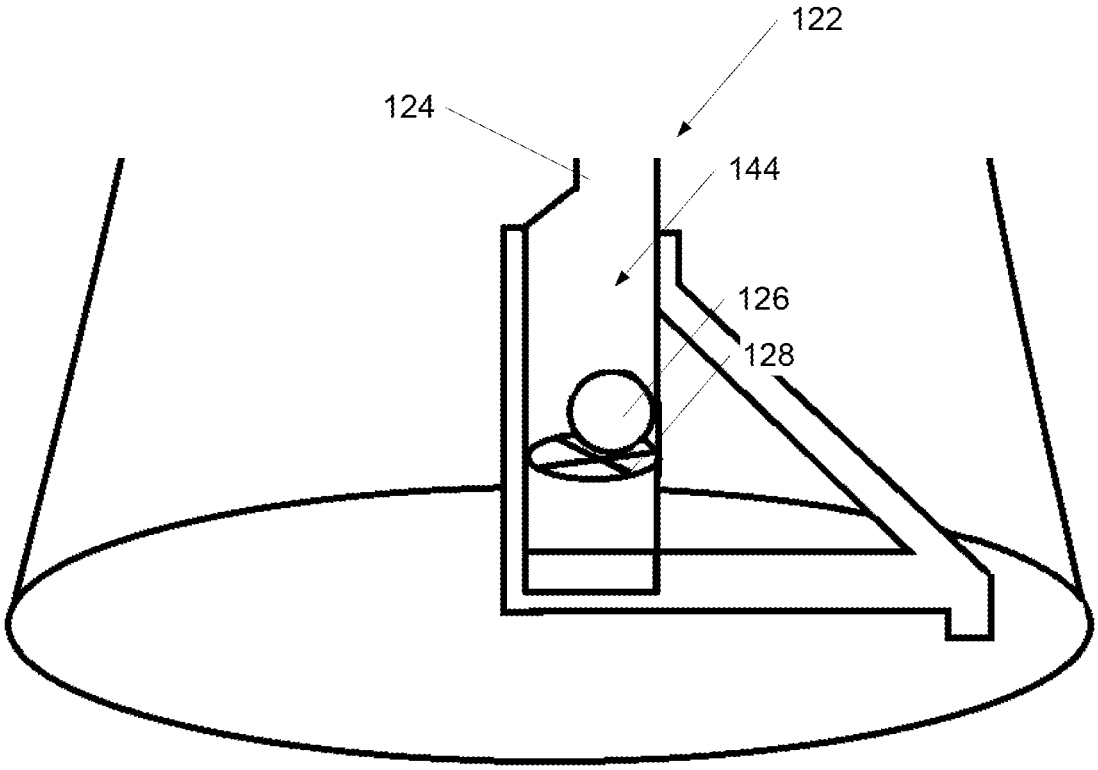
FIG. 3 is a close-up diagram of the second feed of the multi-directional fluid pumping device in an upright configuration using rotating cuffs, in accordance with an embodiment of the invention.

Upright Configuration of the Multi-Directional Fluid Pumping Device Using Rotating Cuffs A multi-directional fluid pumping device using rotating cuffs in various configurations and in accordance with embodiments of the invention is described below. An upright configuration of the multi-directional fluid pumping device in accordance with the various embodiments is depicted in FIGS. 1-3. A diagram of the multi-directional fluid pumping device in an upright position using rotating cuffs, in accordance with an embodiment of the invention illustrated in FIG. 1. The fluid pumping device 100 may include a sprayer head 102 that may be attached to a reservoir 150 that contains a fluid 152. The sprayer head 102 may comprise a piston 104. The sprayer head 102 and the piston 104 may be implemented in a manner well known to one of ordinary skill in the art. The piston 104 may be configured to pump fluid from a first feed 112 and a second feed 122, both of which are enclosed within an encasement member 118. In many embodiments, the first feed 112 may be attached to a first rotating cuff 120 that delivers the fluid 152 through a first perforated zone 114. The first feed 112 may comprise a first cap 116 and a first plug 142 that utilizes a first ball 108 and a first catch 106, and a first constricted portion 110. The first plug 142 may close off the first feed 112 when the first feed 112 may not access the fluid 152 based on a particular configuration, as further described below. The second feed 122 may be attached to a second rotating cuff 134 that delivers the fluid 152 through a second perforated zone 130. An additional support 136 may be added to reinforce the link between the first feed 112 and the first rotating cuff 120, as well as the second feed 122 and the second rotating cuff 134. The second feed 122 may comprise of a second cap 132 and a second plug 144 that utilizes a second ball 126, and a second catch 128, and a second constricted portion 124. The second plug 144 may close off the second feed 122 when the second feed 122 may not access the fluid 152 based on a particular configuration, as further described below.

A close-up diagram of the first feed of the multi-directional fluid pumping device in an upright configuration in accordance with the embodiment of the invention shown in FIG. 2. In many embodiments, the first plug 142 may close off the first feed 112 by using the first ball 108 to seal the first constricted portion 110 of the first feed 112 because fluids may not rise to a level in which the first feed 112 can access. The first catch 106 does not capture the first ball 108 when the first ball 108 seals the first constricted portion 110.

A close-up diagram of the second feed of the multi-directional fluid pumping device in an upright configuration in accordance with the embodiment of the invention shown in FIG. 3. In various embodiments, the second plug 144 may open up the second feed 122 by using the second catch 128 to capture the second ball 126. Fluids can still flow through the second catch 128 and the second constricted portion 124 and be accessed by the second feed 122.

Although specific multi-directional fluid pumping devices are discussed with respect to FIGS. 1-3, any of a variety for multi-directional fluid pumping devices as appropriate to the requirements of a specific application can be utilized in accordance with embodiments of the invention. A sideway configuration of the multi-directional fluid pumping devices using rotating cuffs, in accordance with embodiments of the invention is further discussed below.

Figure 4:
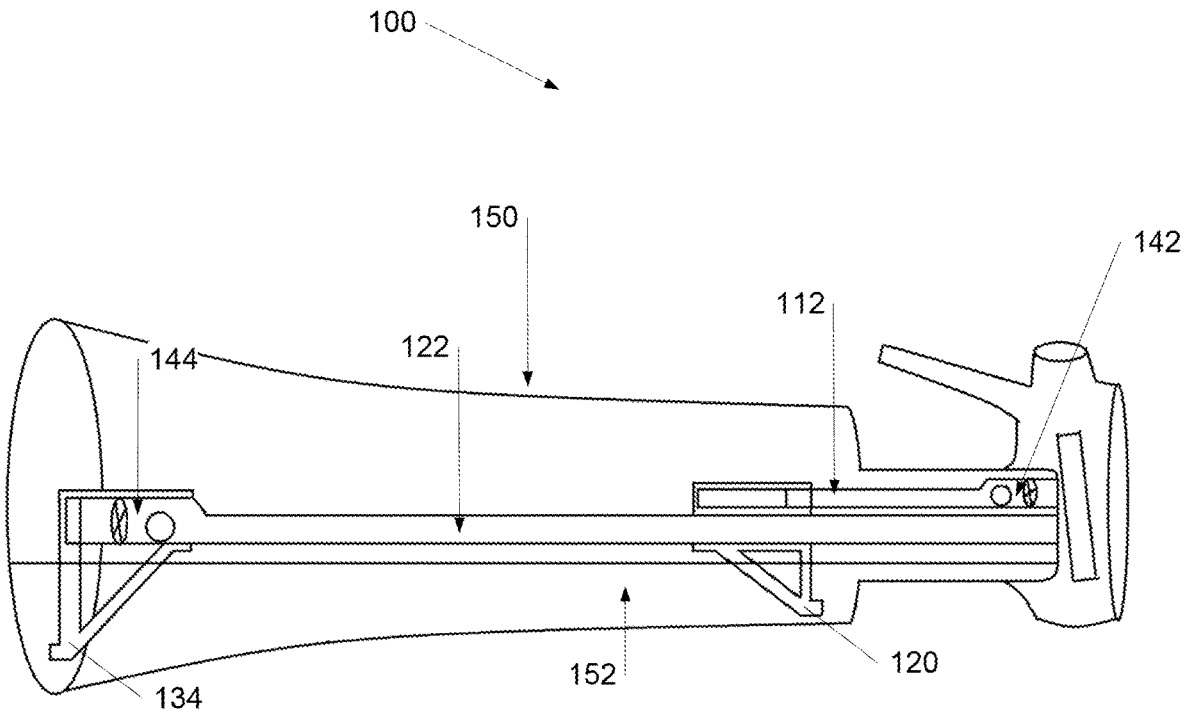
FIG. 4 is a diagram of the multi-directional fluid pumping device in a sideway configuration using rotating cuffs, in accordance with an embodiment of the invention.
Figure 5:
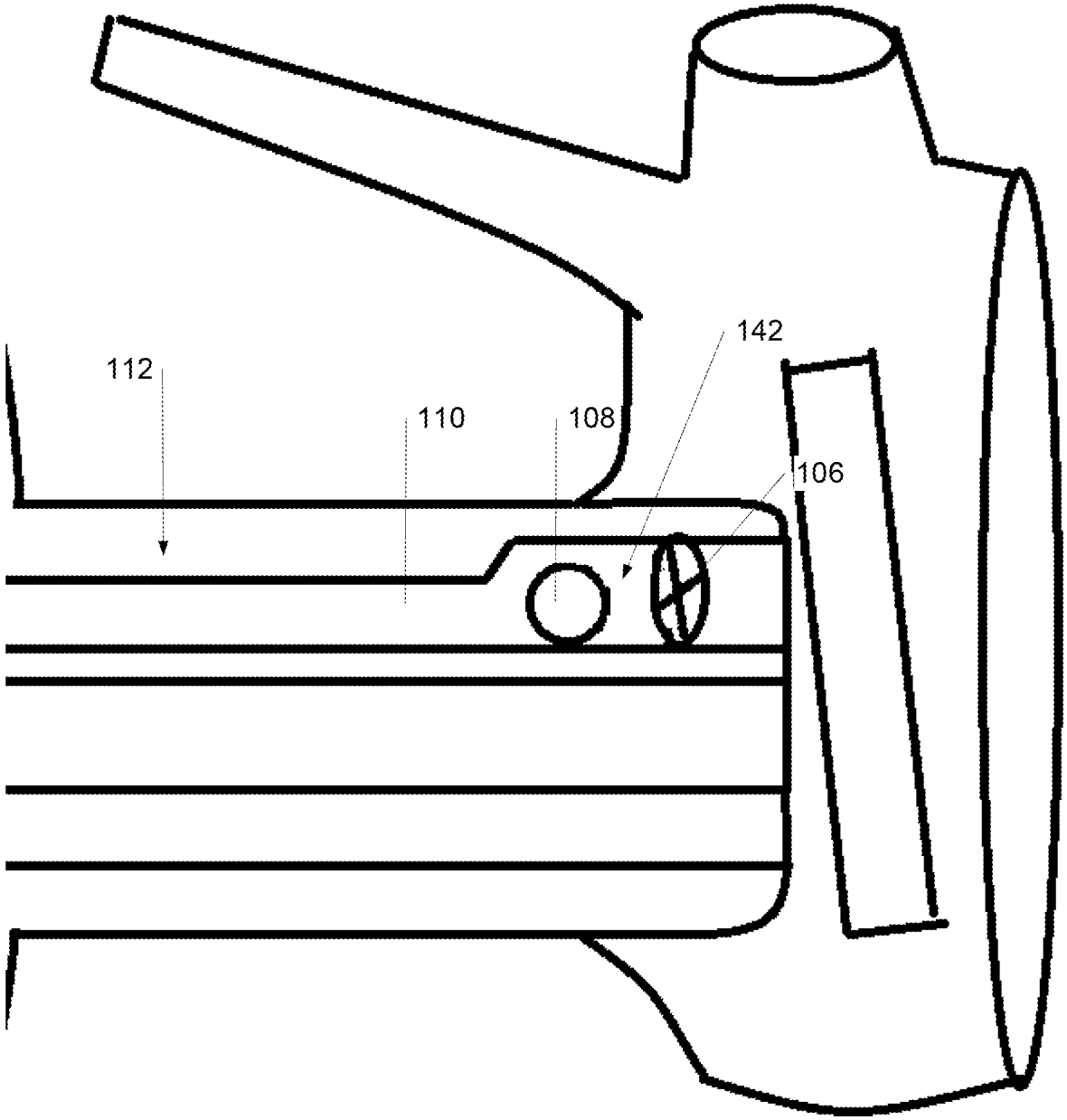
FIG. 5 is a close-up diagram of the first feed of the multi-directional fluid pumping device in a sideway configuration using rotating cuffs, in accordance with an embodiment of the invention.
Figure 6:
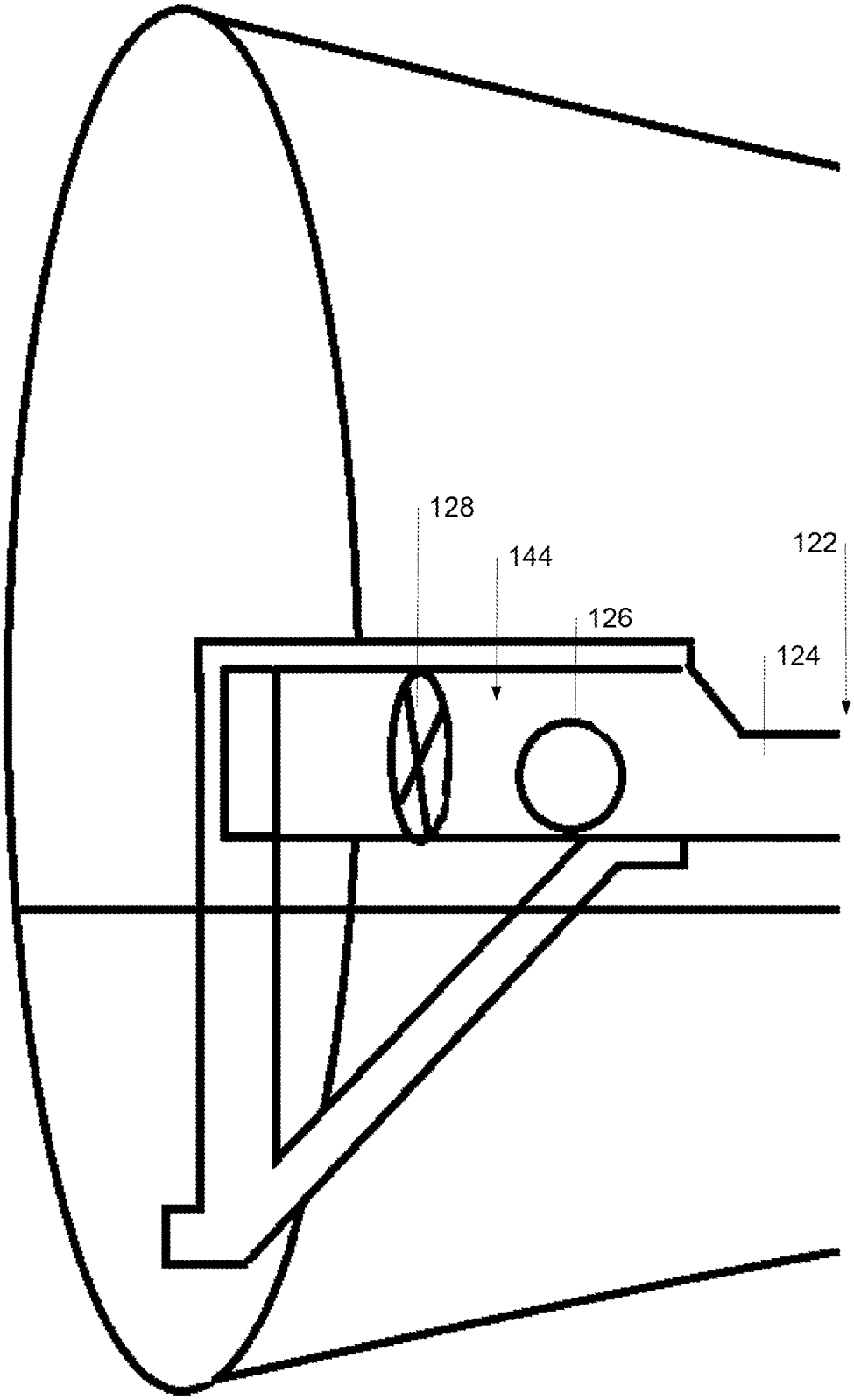
FIG. 6 is a close-up diagram of the second feed of the multi-directional fluid pumping device in a sideway configuration using rotating cuffs, in accordance with an embodiment of the invention.

Sideway Configuration of the Multi-Directional Fluid Pumping Device Using Rotating Cuffs A sideways configuration of the multi-directional fluid pumping device 100 in accordance with the various embodiments is depicted in FIGS. 4-6. A diagram of the multi-directional fluid pumping device 100 in a sideway configuration using rotating cuffs, in accordance with an embodiment of the invention illustrated in FIG. 4. The first rotating cuff 120 and the second rotating cuff 134 may rotate by gravitational force to access the fluid 152 that has moved by gravitational force to occupy the bottom-most of the reservoir 150. The first rotating cuff 120 and the second rotating cuff 134 may deliver the fluid 152 through the first plug 142 of the first feed 112 and the second plug 144 of the second feed 122, as further described below.

A close-up diagram of the first feed of the multi-directional fluid pumping device in a sideway configuration in accordance with the embodiment of the invention shown in FIG. 5. In many embodiments, the first plug 142 may open up the first feed 112 by utilizing the first ball 108 to unseal the first constricted portion 110 of the first feed 112. The first catch 106 does not capture the first ball 108 when the first ball 108 is balanced between the first catch 106 and the first constricted portion 110.

A close-up diagram of the second feed of the multi-directional fluid pumping device in a sideway configuration in accordance with the embodiment of the invention shown in FIG. 6. In many embodiments, the second plug 144 may open up the second feed 122 by utilizing the second ball 126 to unseal the second constricted portion 124 of the second feed 122. The second catch 128 does not capture the second ball 126 when the second ball 126 is balanced between the second catch 128 and the second constricted portion 124.

Although specific multi-directional fluid pumping devices are discussed with respect to FIGS. 4-6, any of a variety for multi-directional fluid pumping devices as appropriate to the requirements of a specific application can be utilized in accordance with embodiments of the invention. An angled configuration of the multi-directional fluid pumping device using rotating cuffs, in accordance with embodiments of the invention is further discussed below.

Figure 7:
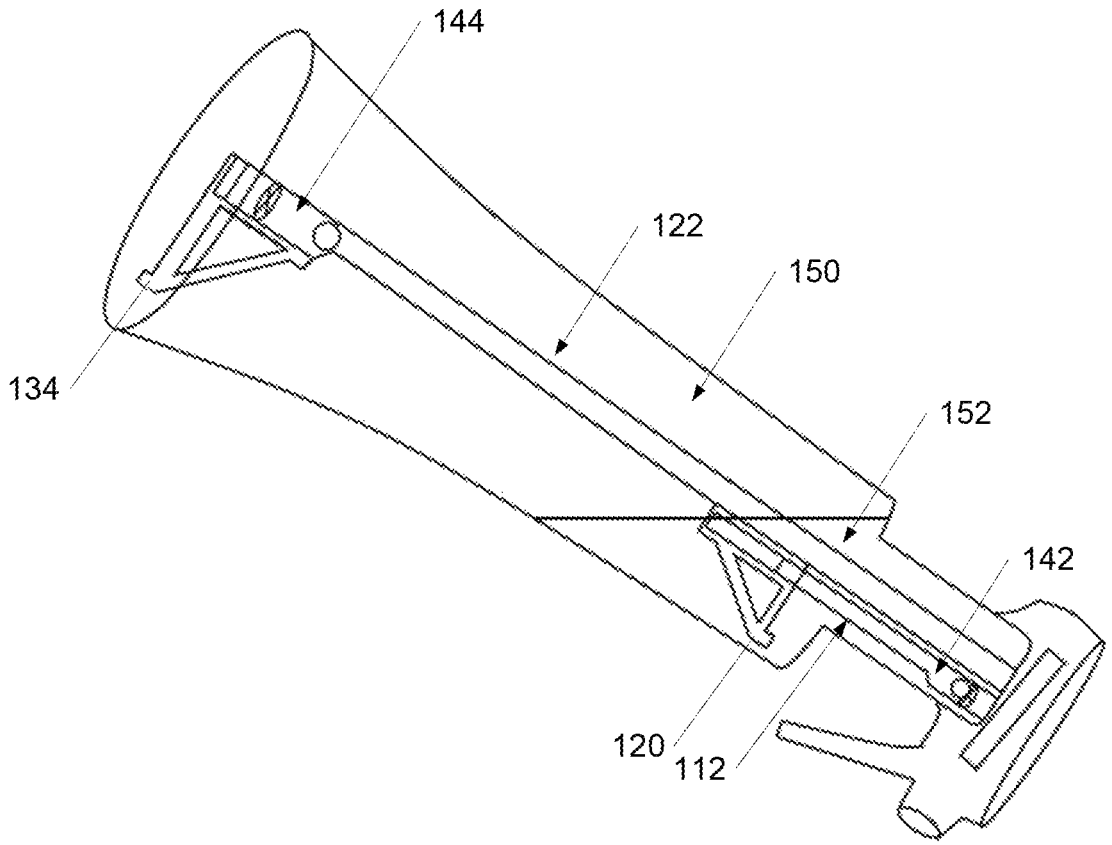
FIG. 7 is a diagram of the multi-directional fluid pumping device in an angled configuration using rotating cuffs, in accordance with an embodiment of the invention.
Figure 8:
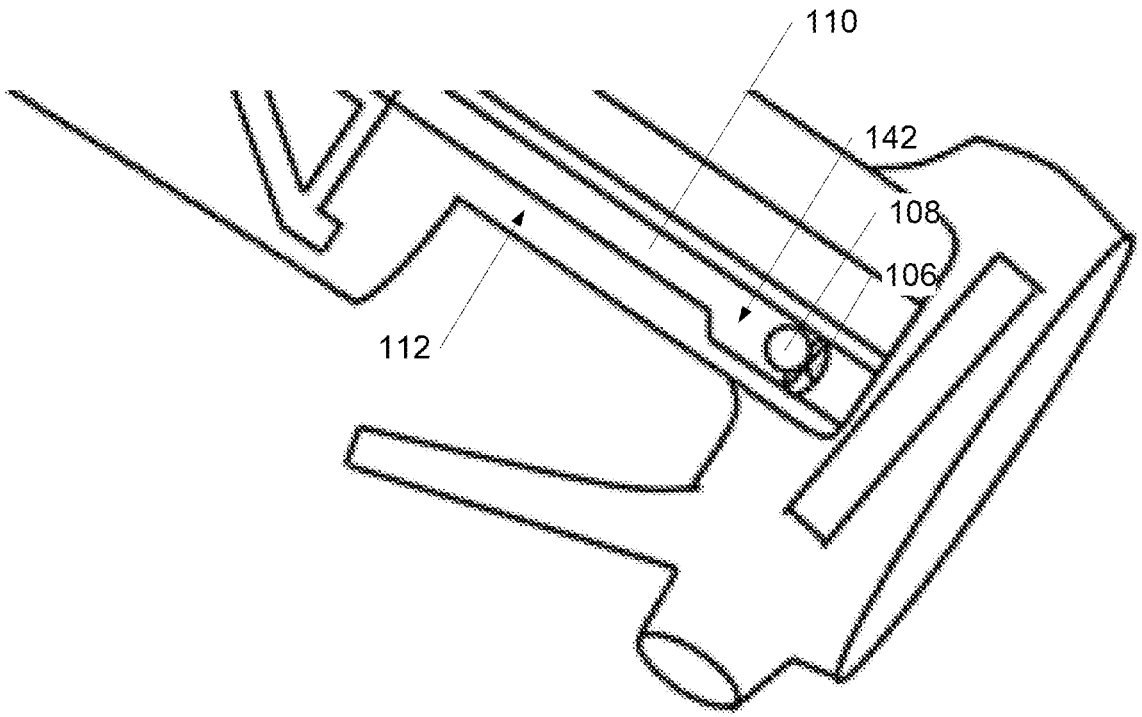
FIG. 8 is a close-up diagram of the first feed of the multi-directional fluid pumping device in an angled configuration using rotating cuffs, in accordance with an embodiment of the invention.
Figure 9:
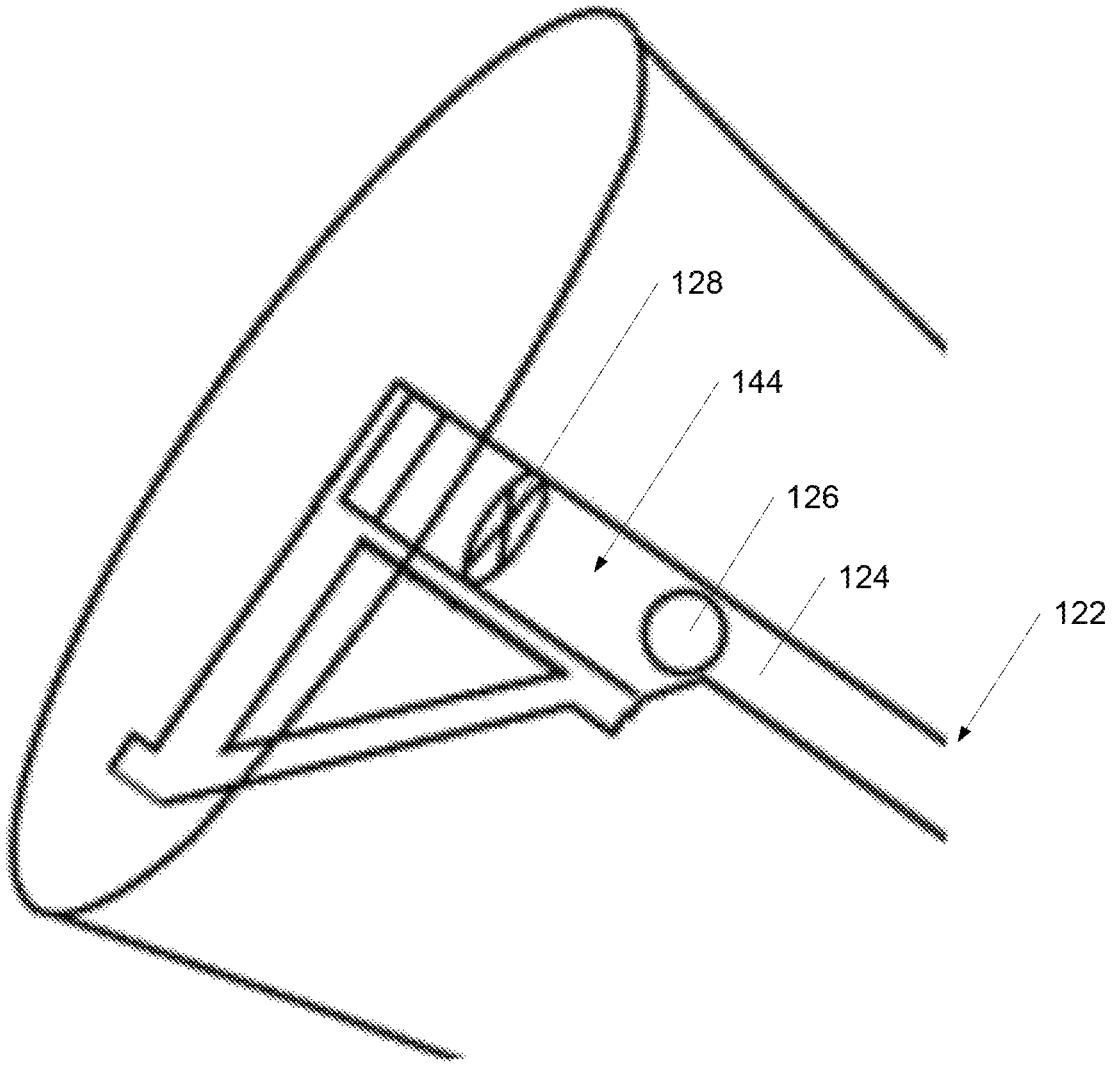
FIG. 9 is a close-up diagram of the second feed of the multi-directional fluid pumping device in an angled configuration using rotating cuffs, in accordance with an embodiment of the invention.

Angled Configuration of the Multi-Directional Fluid Pumping Device Using Rotating Cuffs An angled configuration of the multi-directional fluid pumping device in accordance with the various embodiments is depicted in FIGS. 7-9. A diagram of the multi-directional fluid pumping device using rotating cuffs in an angled configuration is shown in FIG. 7. The first rotating cuff 120 may rotate to and deliver the fluid 152 from the reservoir 150 when the reservoir 150 is in an angled position through the first plug 142 of the first feed 112, while the second feed 122 is closed by the second plug 144 because the second rotating cuff 134 cannot access the fluid 152, as further described below.

A close-up diagram of the first feed of the multi-directional fluid pumping device in an angled configuration in accordance with the embodiment of the invention shown in FIG. 8. In many embodiments, the first plug 142 may open up the first feed 112 by using the first catch 106 to capture the first ball 108. Fluids can still flow through the first catch 106 and the first constricted portion 110 and be accessed by the first feed 112.

A close-up diagram of the second feed of the multi-directional fluid pumping device in an angled configuration in accordance with the embodiment of the invention shown in FIG. 9. In many embodiments, the second plug 144 may close off the second feed 122 by using the second ball 126 to seal the second constricted portion 124 of the second feed 122 because fluids may not rise to a level in which the second feed 122 can access. The second catch 128 does not capture the second ball 126 when the second ball 126 seals the second constricted portion 124.

Although specific processes for multi-directional fluid pumping are discussed with respect to FIGS. 7-9, any of a variety for multi-directional fluid pumping as appropriate to the requirements of a specific application can be utilized in accordance with embodiments of the invention. An upright configuration of the multi-directional fluid pumping device using feed extensions, in accordance with embodiments of the invention is further discussed below.

Figure 10:
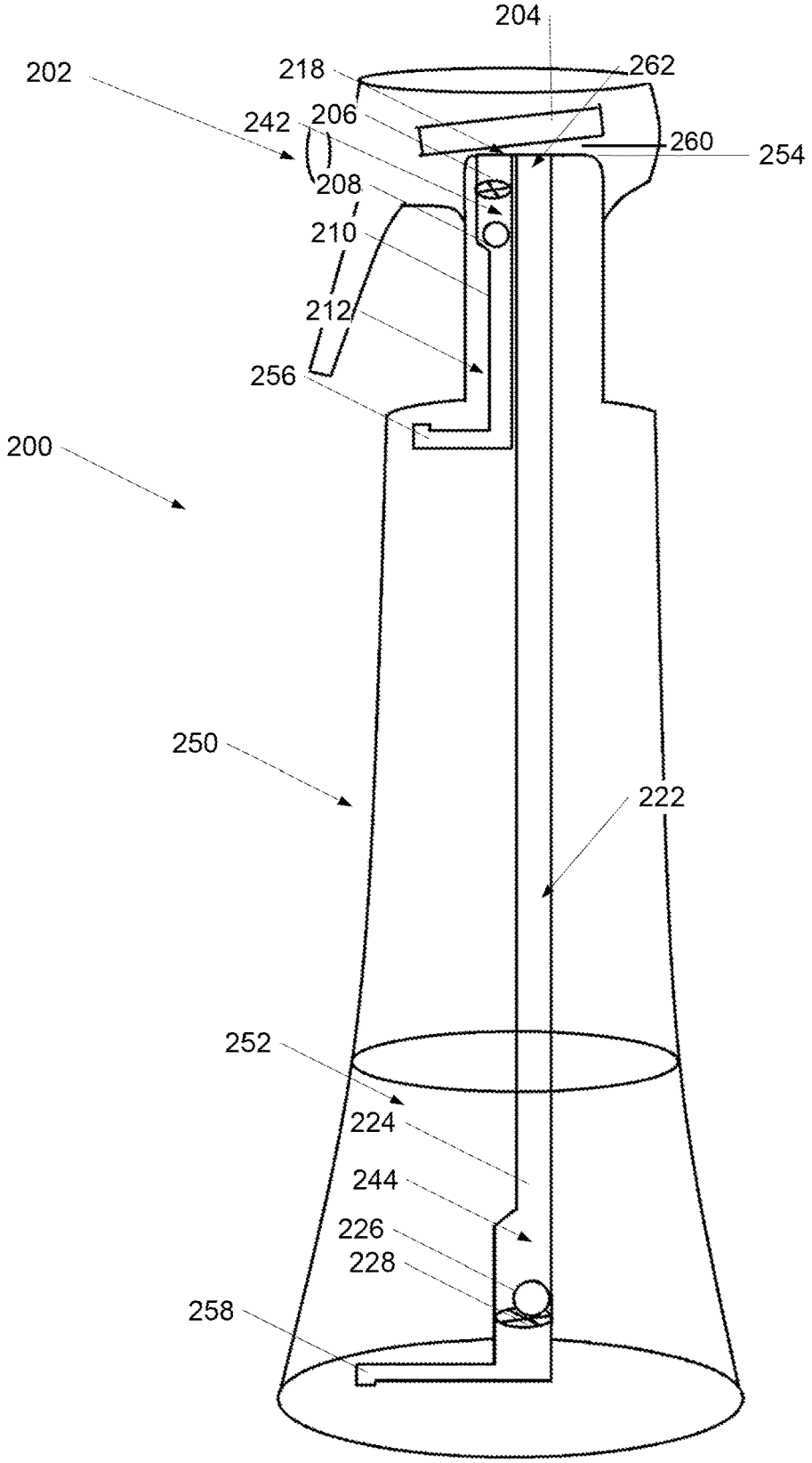
FIG. 10 is diagram of the multi-directional fluid pumping device in an upright configuration using feed extensions, in accordance with an embodiment of the invention.
Figure 11:
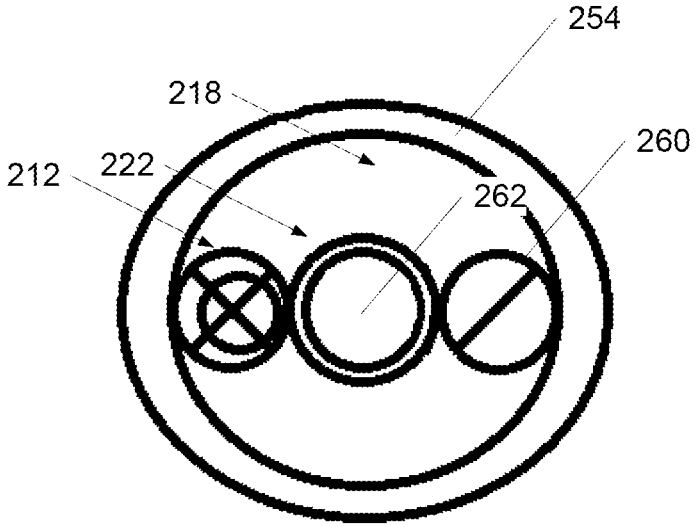
FIG. 11 is a cross sectional diagram of the feed configuration of the multi-directional fluid pumping device in an upright configuration using feed extensions, in accordance with an embodiment of the invention.

Upright Configuration of the Multi-Directional Fluid Pumping Device Using Feed Extensions A multi-directional fluid pumping device using feed extensions in various configurations and in accordance with embodiments of the invention is described below. An upright configuration of the multi-directional fluid pumping device using feed extensions in accordance with the various embodiments is depicted in FIGS. 10-11. A diagram of the multi-directional fluid pumping device in an upright configuration using feed extensions is illustrated in FIG. 10. The fluid pumping device 200 may include a sprayer head 202 that may be attached to a reservoir 250 that contains a fluid 252. The sprayer head 202 may comprise a piston 204. The sprayer head 202 and the piston 204 may be implemented in a manner well known to one of ordinary skill in the art. The piston 204 may pump fluid from the first feed 212 and second feed 222, both of which may be enclosed within an encasement member 218 connected to a wheel bearing 254, as further described below. A dummy piece 260 may also be attached to the encasement member 218 to balance the first feed 212. The first feed 212 may be attached to a first extension 256 that accesses and delivers the fluid 252. The first feed 212 may comprise of a first plug 242 that may comprise of a first ball 208, and a first catch 206, and a first constricted portion 210. The first plug 242 may close off the first feed 212 when the first feed 212 may not access the fluid 252 based on a particular configuration, as further described below. The first feed 212 may rotate about a central axis 262 of the second feed 222. The second feed 212 may be attached to a second extension 258 that rotates about the central axis 262 and accesses the fluid. The second feed 222 may comprise of a second plug 244 that may comprise of a second ball 226, and a second catch 228, and a second constricted portion 224. The second plug 244 may close off the second feed 222 when the second feed 222 may not access the fluid 252 based on a particular configuration, as further described below.

In an upright configuration of the multi-directional fluid pumping device using feed extensions in accordance with the various embodiments in FIG. 10. The first plug 242 may close off the first feed 212 by utilizing the first ball 208 to seal the first constricted portion 210. The second plug 244 may open up the second feed 222 by utilizing the second catch 228 to capture the second ball 226 and allow the second piece 258 to deliver the fluid 252 through the second feed 222.

A cross sectional diagram of the wheel bearing and feed configuration of the multi-directional fluid pumping device in an upright configuration using feed extensions is shown in FIG. 11. In many embodiments, the first feed 212 and the second feed 222 may be attached to an encasement member 218 that is connected to a wheel bearing 254. A dummy piece 260 may also be attached to the encasement member 218. The dummy piece 260 and the first feed 212, may rotate in the same direction about the central axis 262. The second extension 258 may rotate about the central axis 262 of the second feed 222.

Although specific multi-directional fluid pumping devices are discussed with respect to FIGS. 10-11, any of a variety for multi-directional fluid pumping devices as appropriate to the requirements of a specific application can be utilized in accordance with embodiments of the invention.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A multi-directional fluid pumping device, comprising:

a reservoir containing a fluid;

a sprayer head attached to the reservoir, the sprayer head comprising a piston that connects to a top portion of a first feed and a top portion of a second feed;

a first plug that closes off the first feed when the sprayer head is in an upright configuration;

a second plug that closes off the second feed when the sprayer head is in an upside-down configuration;

a first piece connected to the first feed, wherein the first feed provides access to the fluid in the reservoir; and a second piece connected to the second feed, wherein the second feed provides access to the fluid in the reservoir; and wherein the first piece includes a first rotating cuff that rotates about the first feed using gravity to provide access to the fluid.

2. The multi-directional fluid pumping device of claim 1, wherein the first plug comprises a first constricted portion, such that a cross-sectional area of the first feed is larger closer to a first catch than away from it.

3. The multi-directional fluid pumping device of claim 1, wherein the second plug comprises a second constricted portion, such that a cross-sectional area of the second feed is larger closer to a second catch than away from it.

4. The multi-directional fluid pumping device of claim 2, wherein the first plug comprises a first ball and the first catch, wherein in the upright configuration the first catch does not capture the first ball and closes off the first feed and in the upside-down configuration the first catch captures the first ball and opens up the first feed.

5. The multi-directional fluid pumping device of claim 3, wherein the second plug comprises of a second ball and the second catch, wherein in the upright configuration the second catch captures the second ball and opens up the second feed and in the upside-down configuration the second catch does not capture the second ball and closes off the second feed.

6. The multi-directional fluid pumping device of claim 1, wherein the second piece includes a second rotating cuff that rotates about the second feed using gravity to provide access to the fluid.

7. The multi-directional fluid pumping device of claim 1, wherein the first feed and the second feed may be sealed at a base.

8. A method for pumping fluids, the method comprising:

inputting a fluid into a reservoir connected to a sprayer head;

positioning the sprayer head so that the sprayer head faces a targeted location, wherein the sprayer head comprises a piston that connects to a first feed and a second feed;

rotating a first piece such that the first feed connected to the first piece accesses the fluid in the reservoir, wherein the first piece includes a first rotating cuff that rotates about the first feed using gravity to provide access to the fluid;

rotating a second piece such that the second feed connected to the second piece accesses the fluid in the reservoir;

closing off the first feed with a first plug when the sprayer head is in an upright configuration;

closing off the second feed with a second plug when the sprayer head is in an upside-down configuration; and pumping the fluid to the sprayer head through the first and second feed using the piston and then to the targeted location.

9. The method of claim 8, wherein the first plug comprises a first constricted portion, such that a cross-sectional area of the first feed is larger closer to a first catch than away from it.

10. The method of claim 8, wherein the second plug comprises a second constricted portion, such that a cross-sectional area of the second feed is larger closer to a second catch than away from it.

11. The method of claim 9, wherein the first plug comprises a first ball and the first catch, wherein in the upright configuration the first catch does not capture the first ball and closes off the first feed and in the upside-down configuration the first catch captures the first ball and opens up the first feed.

12. The method of claim 10, wherein the second plug comprises of a second ball and the second catch, wherein in the upright configuration the second catch captures the second ball and opens up the second feed and in the upside-down configuration the second catch does not capture the second ball and closes off the second feed.

13. The method of claim 8, wherein the second piece includes a second rotating cuff that rotates about the second feed using gravity to provide access to the fluid.

14. The method of claim 8, wherein the first feed and the second feed are sealed at a base.

* * * * *